US009544671B2

(12) United States Patent
Shi et al.

(10) Patent No.: US 9,544,671 B2
(45) Date of Patent: Jan. 10, 2017

(54) SPEAKER-BOX

(71) Applicants: Lei Shi, Shenzhen (CN); Wentao Jiang, Shenzhen (CN); Linzhen Li, Shenzhen (CN)

(72) Inventors: Lei Shi, Shenzhen (CN); Wentao Jiang, Shenzhen (CN); Linzhen Li, Shenzhen (CN)

(73) Assignees: AAC Acoustic Technologies (Shenzhen) Co., Ltd., Shenzhen (CN); AAC Microtech (changzhou) Co., Ltd., Jiangsu Province (CN)

( * ) Notice: Subject to any disclaimer, the term of this patent is extended or adjusted under 35 U.S.C. 154(b) by 230 days.

(21) Appl. No.: 13/747,751

(22) Filed: Jan. 23, 2013

(65) Prior Publication Data

US 2013/0259284 A1 Oct. 3, 2013

(30) Foreign Application Priority Data

Apr. 2, 2012 (CN) ..... 2012 2 0141527 U

(51) Int. Cl.
*H04R 1/02* (2006.01)

(52) U.S. Cl.
CPC ..... *H04R 1/025* (2013.01); *H04R 1/023* (2013.01)

(58) Field of Classification Search
CPC ..... H04R 1/2819; H04R 1/02; H04R 5/02; H04R 9/045; H04R 9/06; H04R 25/60;H04R 1/26; H04R 1/08; H04R 1/025; H04R 9/022; H04R 2201/028; H04R 1/028; H04R 2499/11; H04R 2499/15; H04R 2205/026; H04R 2400/00; H04R 2499/13; H04R 27/00; H04R 31/00; H04R 1/023; H04R 1/323; H04R 2201/02; G02F 1/133385; G10K 11/1788
USPC ..... 381/71.7, 138, 159, 304, 305, 324, 335,381/366, 386, 397, 345
See application file for complete search history.

(56) References Cited

U.S. PATENT DOCUMENTS 6,259,798 B1 * 7/2001 Perkins ..... H04R 9/022 181/199
2004/0196999 A1 * 10/2004 Han ..... H04R 1/2819 381/345
2006/0039571 A1 * 2/2006 Harris ..... H04R 9/022 381/87
2007/0076914 A1 * 4/2007 Takagi ..... H04R 9/02 381/396
2008/0075317 A1 * 3/2008 Chen ..... G06F 1/203 381/397
2012/0230499 A1 * 9/2012 Suzuki ..... H04R 1/025 381/55

* cited by examiner

*Primary Examiner* — Akelaw Teshale
(74) *Attorney, Agent, or Firm* — Na Xu; IPro, PLLC

(57) ABSTRACT

Disclosed is a speaker-box. The speaker-box includes a case, a speaker unit received in the case and a heat radiating portion attached on the base and directly connecting to a part of the speaker unit for dissipating the heat generated by the speaker unit.

8 Claims, 6 Drawing Sheets

SPEAKER-BOX

FIELD OF THE INVENTION

The present invention generally relates to a speaker, and more particularly, to a speaker-box.

DESCRIPTION OF RELATED ART

Speaker boxes are widely used in many types of portable electronic devices, such as mobile phones, notebook computers, and hearing aids, for converting audio electrical signals to audible sounds.

A speaker box, related to the present invention, generally includes a case having a closed receiving cavity and a speaker unit received in the closed receiving cavity of the case. However, since a speaker unit is totally received in the closed receiving cavity of the case, it has a poor heat dissipation capability, which results in a poor capability against high power inputs.

DETAILED DESCRIPTION OF THE EXEMPLARY EMBODIMENTS

Figure 1:
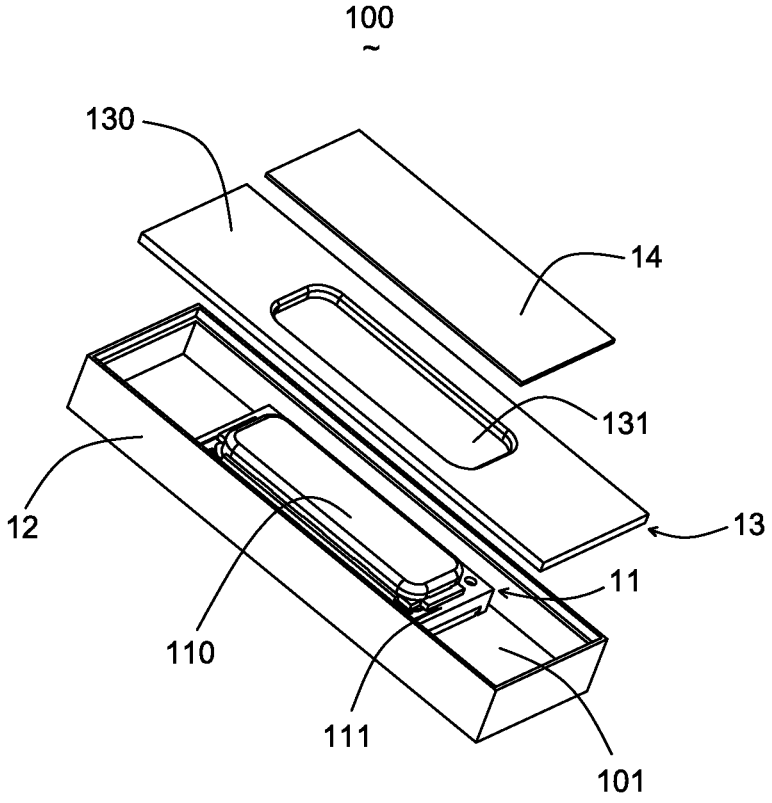
FIG. 1 is an illustrative exploded view of a speaker-box in accordance with a first exemplary embodiment of the present disclosure.
Figure 2:
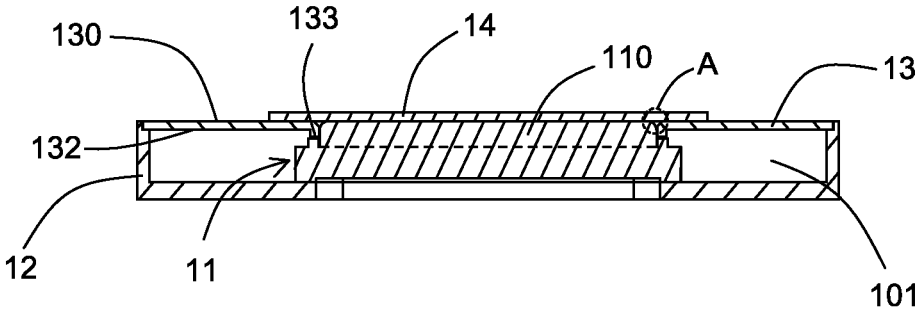
FIG. 2 is an illustrative cross-sectional view of a speaker-box in FIG. 1.
Figure 3:
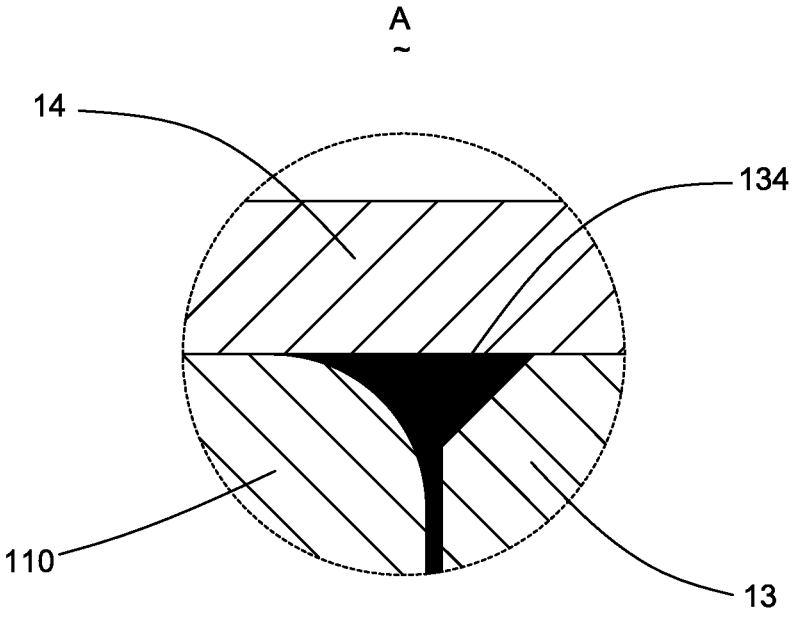
FIG. 3 is an illustrative enlarged view of Part A in FIG. 2.

Referring to FIGS. 1 through 4, a speaker-box 100 in accordance with a first exemplary embodiment of the present disclosure comprises a case, a speaker unit 11 received in the case and a heat radiating portion 14 attached on the case and connected with the speaker unit 11. The case has a base 13, a cover 12 mounted on the base 13, and a receiving room 101 formed by the cover 12 together with the base 13 for receiving the speaker unit 11. The base 13 has a first surface 132 near the speaker unit 11, a second surface 130 opposite to the first surface 132, a through hole 131 extending from the first surface 132 to the second surface 130, and a fixing portion 133 extending toward the cover 12 and surrounding the thought hole 131.

The speaker unit 11 is engaged with the fixing portion 133 and a part thereof received in the thought hole 131 for directly connecting to the heat radiating portion 14. The speaker unit 11 has a holder 111 and a magnetic system 110 positioned by the holder 111. The holder 111 has a sidewall 112 and a hollow space surrounded by the sidewall 112 for receiving the magnetic system 110. The sidewall 112 has a lower surface 113 far away from the cover 12 and an upper surface 114 opposite to the lower surface 113 near the cover 12. At least a part of the magnetic system 110 is projected from the lower surface 113 of the sidewall 112 and engaged with the fixing portion 133 of the base 13 for directly connecting to the heat radiating portion 14.

Figure 4:
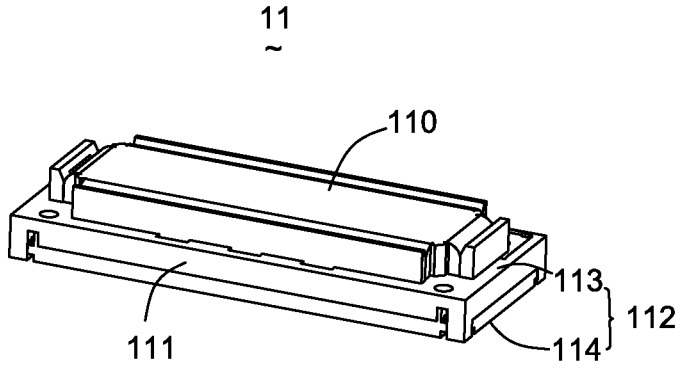
FIG. 4 is an illustrative assembled view of a speaker unit of the speaker-box in FIG. 1.

Referring to FIG. 4, the speaker-box 100 further has a space formed by the base 13 together with the magnetic system 110 and the heat radiating portion 14. The space is filled with adhesive 134 for fixing the base 12 together with the magnetic system 110 and the heat radiating portion 14. In this embodiment, the heat radiating portion 14 is a flat heat radiating film.

Figure 5:
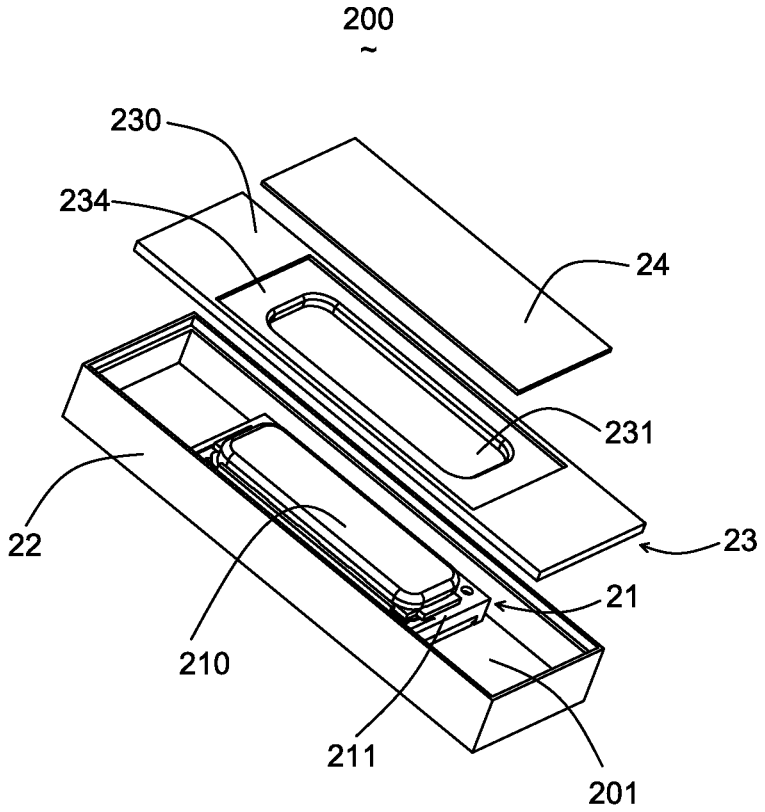
FIG. 5 is an illustrative exploded view of a speaker-box in accordance with a second exemplary embodiment of the present disclosure.
Figure 6:
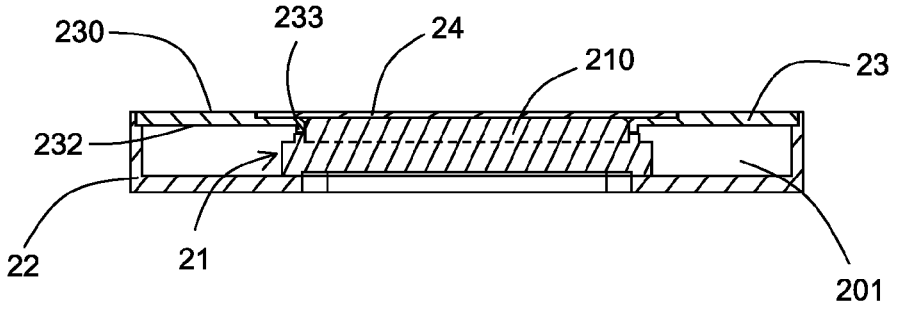
FIG. 6 is an illustrative cross-sectional view of the speaker-box in FIG. 5.

A second embodiment of the present disclosure is shown in FIGS. 5 and 6, a speaker-box 200 comprises a speaker unit 21 with a magnetic system 210, a case for receiving the speaker unit 21 and a heat radiating portion 24 attached on the case and connected with the speaker unit 21. The case has a base 23, a cover 22 mounted on the base 23, and a receiving room 201 formed by the cover 22 together with the base 23 for receiving the speaker unit 21. The base 23 has a first surface 232 near the speaker unit 21, a second surface 230 opposite to the first surface 232, a receiving concave 234 extending from the second surface 230 toward the first surface 232 for receiving the heat radiating portion 24 firmly, a through hole 231 positioned on the receiving concave 234 and drilled completely through the first surface 232 and a fixing portion 233 extending from the first surface 232 far away from the second surface 230 and surrounding the thought hole 231. The heat radiating portion 24 is received in the receiving concave 234 and an outline of the heat radiating portion 24 is equal to that of the receiving concave 234.

The speaker unit 21 is engaged with the fixing portion 233 and a part thereof is received in the thought hole 231 for directly connecting to the heat radiating portion 24. The speaker unit 21 has a holder 211 and a magnetic system 210 received in the holder 211. At least a part of the magnetic system 210 projects from the holder 211 and engages with the fixing portion 233 of the base 23 for directly connecting to the heat radiating portion 24.

Figure 7:
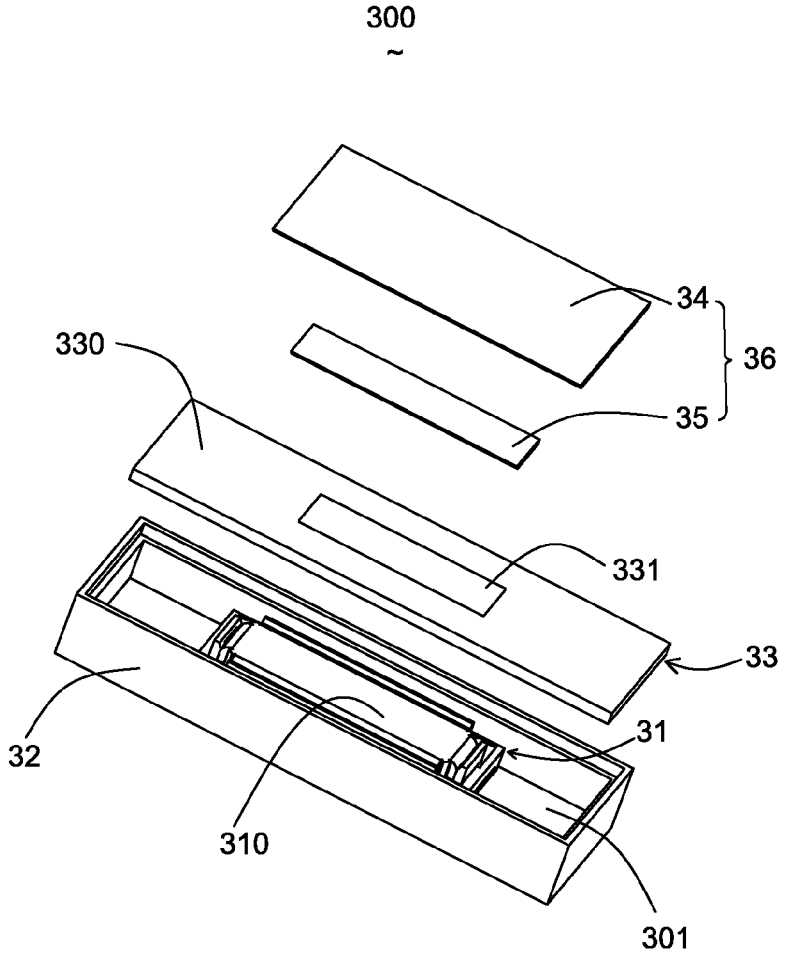
FIG. 7 is an illustrative exploded view of a speaker-box in accordance with a third exemplary embodiment of the present disclosure.
Figure 8:
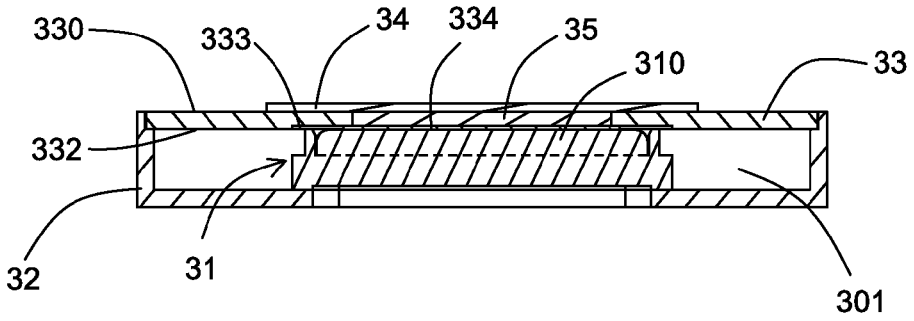
FIG. 8 is an illustrative cross-sectional view of the speaker-box in FIG. 7.

A third embodiment of the present disclosure is shown in FIGS. 7 and 8, a speaker-box 300 comprises a speaker unit 31 with a magnetic system 310, a case for receiving the speaker unit 31 and a heat radiating portion 36 attached on the case and connected with the speaker unit 31. The case has a base 33, a cover 32 mounted on the base 33, and a receiving room 301 formed by the cover 32 together with the base 33 for receiving the speaker unit 31. The base 33 has a first surface 332 near the speaker unit 31, a second surface 330 opposite to the first surface 332, and a through hole 331 drilled completely through the first and second surface 332, 330.

The heat radiating portion 36 has a metal plate 34 insert into the through hole 331 and a platy shape heat radiating film 35 covered on the metal plate 34. When assembled, the metal plate 34 is integrated with the base 32 by injection molding and directly attached on the magnetic system 310 of the speaker unit 31. A part of the heat radiating film 35 is covered on the metal plate 34 for efficiently dissipating the heat generated from the speaker unit 31 and the rest is attached on the second surface 330 for fixing the heat radiating portion 36 on the base 33 firmly.

The base 32 further has a receiving slot 333 extending from the first surface 332 toward the second surface 330 and surrounding the through hole 331 for filing with an adhesive 334. Thus, the magnetic system 310 is connected with the metal plate 34 by the adhesive 334.

Figure 9:
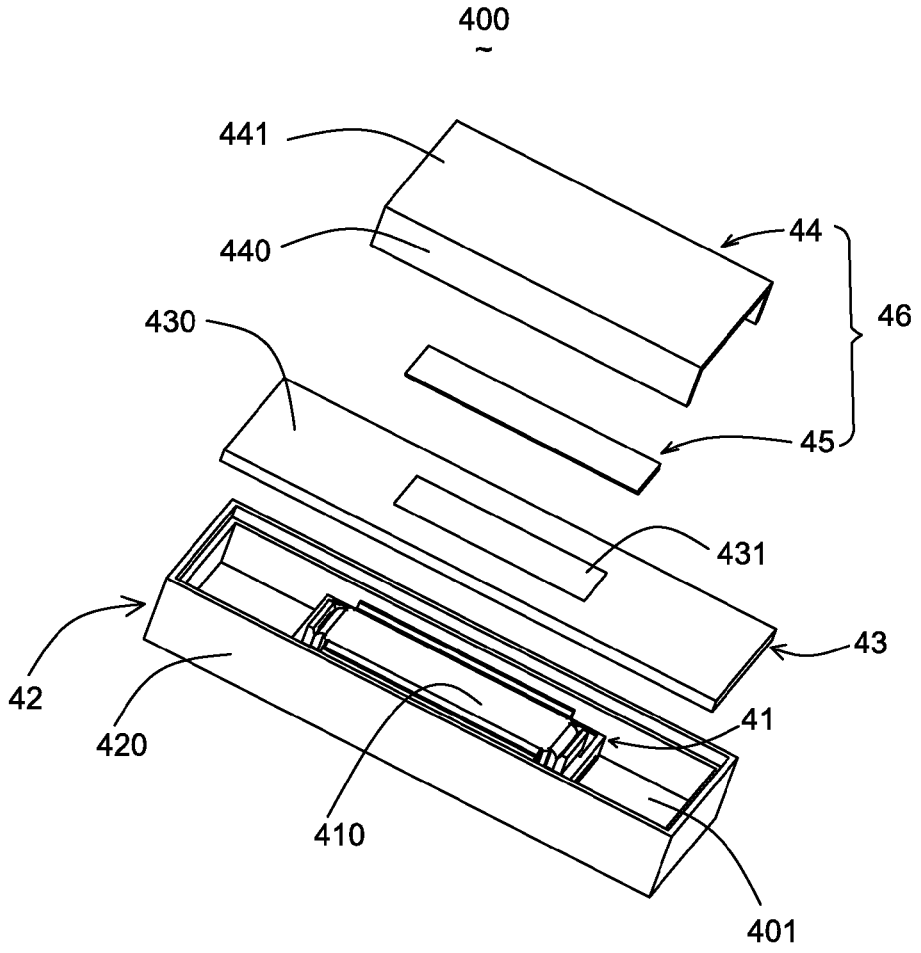
FIG. 9 is an illustrative exploded view of a speaker-box in accordance with a fourth exemplary embodiment of the present disclosure.
Figure 10:
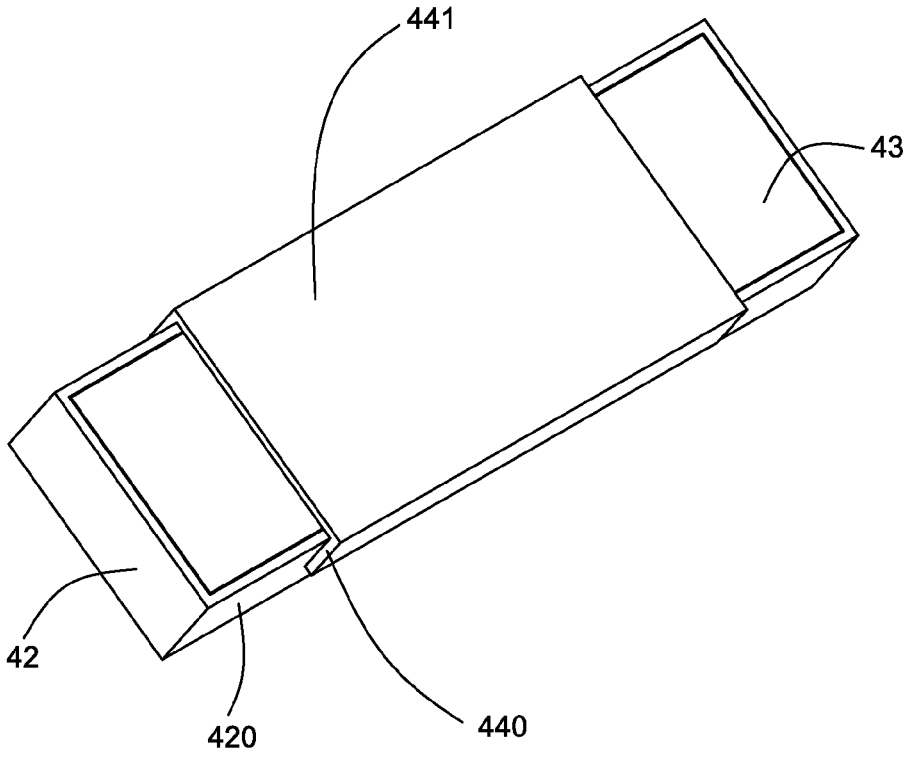
FIG. 10 is an illustrative assembled view of the speaker-box in FIG. 9.
Figure 11:
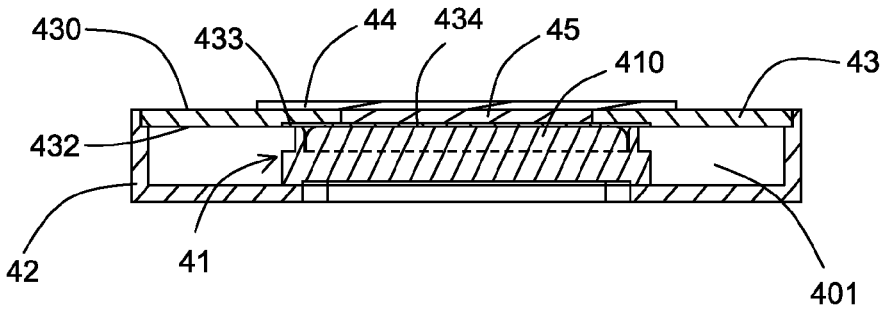
FIG. 11 is an illustrative cross-sectional view of the speaker-box in FIG. 9.

A fourth embodiment of the present disclosure is shown in FIGS. 9 to 11, a speaker-box 400 comprises a speaker unit 41 with a magnetic system 410, a case for receiving the speaker unit 41 and a heat radiating portion 46 attached on the case and connected with the speaker unit 41. The case has a base 42, a cover 43 mounted on the base 42, and a receiving room 401 formed by the cover 43 together with the base 42 for receiving the speaker unit 41. The base 42 has a first surface 432 near the speaker unit 41, a second surface 430 opposite to the first surface 432, and a through hole 431 drilled completely through the first and second surface 432, 430. The cover 42 has a surrounding wall 420 for forming the receiving room 401.

The heat radiating portion 46 has a metal plate 45 inserting into the through hole 431 and a heat radiating film 44 covered on the metal plate 45. The heat radiating film 44 has a platy portion 441 attached on the metal plate 45 and a pair of extending portion 440 extending from two opposite ends of the platy portion 441 and away from the platy portion 441 for engaging with the surrounding wall 420 of the cover 42. When assembled, the metal plate 45 is integrated with the base 43 by injection molding and directly attached on the magnetic system 410 of the speaker unit 41. A part of the platy portion 441 is covered on the metal plate 45 and the rest is attached on the second surface 430 of the base 43 and directly connected with the magnetic system 410. The extending portion 440 is engaged with the surrounding wall 420 of the cover 42.

The base 43 further has a receiving slot 433 extending from the first surface 432 toward the second surface 430 and surrounding the through hole 433 for filing with an adhesive 434. Thus, the magnetic system 410 is connected with the metal plate 45 by the adhesive 434.

Since the speaker-box has the through hole and the speaker unit exposed out of the through hole for directly connecting with the heat radiating portion, the heat generated from the speaker unit can be dissipated by the heat radiating portion, thereby improving the heat dissipating characteristic of the speaker-box and the withstanding capability against high level input signals.

While the present invention has been described with reference to the specific embodiments, the description of the invention is illustrative and is not to be construed as limiting the invention. Various of modifications to the present invention can be made to the exemplary embodiments by those skilled in the art without departing from the true spirit and scope of the invention as defined by the appended claims.

What is claimed is:

1. A speaker-box comprising:

a case having a base, a cover mounted on the base, and a receiving room formed by the cover together with the base, the base including a through hole;

a speaker unit received in the receiving room, at least a part of the speaker unit being received in the through hole; and a heat radiating portion attached on the base and physically connecting to the part of the speaker unit received in the through hole for dissipating the heat generated by the speaker unit.

2. The speaker-box as described in claim 1, wherein the speaker unit has a holder and a magnetic system received in the holder, and at least a part of the magnetic system projects from the holder and is received in the thought hole for directly being connecting to the heat radiating portion via the through hole.

3. The speaker-box as described in claim 2, wherein the base further has a fixing portion extending toward the cover and surrounding the through hole for fixing the speaker unit on the base firmly.

4. The speaker-box as described in claim 1, wherein the heat radiating portion has a metal plate inserting in the thought hole and integrated with the base by injection molding and a heat radiating film covered on the metal plate.

5. The speaker-box as described in claim 4, wherein a part of the heat radiating film is covered on the metal plate for efficiently dissipating the heat and the rest is attached on the second surface for fixing the heat radiating portion on the case firmly.

6. The speaker-box as described in claim 4, wherein the heat radiating film has a platy portion attached on the metal plate and a pair of extending portions extending from two opposite ends of the platy portion and away from the platy portion for engaging with the cover.

7. The speaker-box as described in claim 1, wherein the base further has a receiving concave extending from the second surface toward the first surface for receiving the heat radiating portion and the through hole is provided on the receiving concave.

8. The speaker-box as described in claim 1, wherein the base further has a receiving slot extending from the first surface toward the second surface and surrounding the through hole for filing with an adhesive which is connected with the magnetic system and the heat radiating portion.

* * * * *